US008482509B2

(12) United States Patent
Choe et al.

(10) Patent No.: US 8,482,509 B2
(45) Date of Patent: Jul. 9, 2013

(54) METHOD OF DRIVING A DISPLAY APPARATUS TO COMPENSATE FOR UNEVEN BACKLIGHTING

(75) Inventors: Weon-Jun Choe, Seoul (KR); Kyoung-Phil Kim, Cheonan-si (KR); Dae-Gwang Jang, Incheon (KR)

(73) Assignee: Samsung Display Co., Ltd. (KR)

( * ) Notice: Subject to any disclaimer, the term of this patent is extended or adjusted under 35 U.S.C. 154(b) by 500 days.

(21) Appl. No.: 12/608,763

(22) Filed: Oct. 29, 2009

(65) Prior Publication Data

US 2010/0245397 A1 Sep. 30, 2010

(30) Foreign Application Priority Data

Mar. 24, 2009 (KR) ..... 10-2009-0024794

(51) Int. Cl.
*G09G 3/36* (2006.01)

(52) U.S. Cl.
USPC ..... 345/102; 345/89

(58) Field of Classification Search
USPC ..... 345/87–104, 211–213
See application file for complete search history.

(56) References Cited

U.S. PATENT DOCUMENTS

| | | | | |
|---|---|---|---|---|
| 5,974,174 | A * | 10/1999 | Hozumi | 382/199 |
| 6,608,617 | B2 | 8/2003 | Hoffknecht et al. | |
| 2005/0184952 | A1* | 8/2005 | Konno et al. | 345/102 |
| 2006/0103621 | A1* | 5/2006 | Feng | 345/102 |
| 2007/0247833 | A1* | 10/2007 | Lee et al. | 362/97 |
| 2007/0262947 | A1* | 11/2007 | Wang et al. | 345/102 |
| 2007/0285379 | A1* | 12/2007 | Jung et al. | 345/102 |
| 2008/0050031 | A1* | 2/2008 | Itoh et al. | 382/260 |
| 2008/0252666 | A1* | 10/2008 | Chen et al. | 345/690 |
| 2008/0272999 | A1* | 11/2008 | Kurokawa et al. | 345/89 |
| 2008/0278432 | A1* | 11/2008 | Ohshima | 345/102 |
| 2009/0015728 | A1* | 1/2009 | Abe et al. | 348/739 |
| 2009/0079768 | A1* | 3/2009 | Huang | 345/691 |

FOREIGN PATENT DOCUMENTS

| | | | |
|---|---|---|---|
| KR | 1020050112905 | A | 12/2005 |
| KR | 1020060126246 | A | 12/2006 |
| KR | 1020070104149 | A | 10/2007 |
| KR | 100828104 | B1 | 4/2008 |
| KR | 1020080045873 | A | 5/2008 |
| KR | 1020080058518 | A | 6/2008 |
| KR | 1020080068947 | A | 7/2008 |
| KR | 1020080078095 | A | 8/2008 |
| KR | 100868531 | B1 | 11/2008 |

* cited by examiner

*Primary Examiner* — Chanh Nguyen
*Assistant Examiner* — Sanghyuk Park
(74) *Attorney, Agent, or Firm* — Innovation Counsel LLP

(57) ABSTRACT

A method for driving a display apparatus, according to one or more embodiments of the present invention, provides a luminance representative value of a unit light-emitting block that may be determined from an external image signal of a plurality of image blocks corresponding to the unit light-emitting block including a plurality of light sources. A luminance compensation value of the unit light-emitting block may be calculated by compensating the luminance representative value. Pixel data of the external image signal in a central area of the unit light-emitting block and a boundary area may be corrected based on the luminance compensation value. A driving signal may be provided to the unit light-emitting block based on the luminance compensation value. Accordingly, a phenomenon in which a boundary of the unit light-emitting block is visible is removed so that the display quality of all image may be enhanced.

12 Claims, 9 Drawing Sheets

METHOD OF DRIVING A DISPLAY APPARATUS TO COMPENSATE FOR UNEVEN BACKLIGHTING

RELATED APPLICATIONS

This application claims priority to and benefit of Korean Patent Application No. 2009-0024794, filed on Mar. 24, 2009, in the Korean Intellectual Property Office (KIPO), the contents of which are herein incorporated by reference in their entirety.

BACKGROUND

1. Technical Field

Example embodiments of the present invention relate to a method of driving a display apparatus, and in particular, example embodiments of the present invention relate to a method of driving a display apparatus for enhancing display quality.

2. Related Art

Generally, liquid crystal display (LCD) devices include an LCD panel that displays images using light transmittance of liquid crystal molecules and a backlight assembly disposed below the LCD panel to provide the LCD panel with light.

The backlight assembly includes a light source generating light required to display an image on the LCD panel. The light source includes a cold cathode fluorescent lamp (CCFL), a flat-type fluorescent lamp (FFL), a light-emitting diode (LED), etc.

The LED may be manufactured in a chip form. The LED has advantages of long lifetime, fast lighting, low power consumption, so that the LED is used as a backlight source.

The backlight assembly may be classified as a direct illumination type backlight assembly or an edge illumination type backlight assembly in accordance with a disposing position of the light source. With a direct illumination type backlight assembly, a plurality of light sources is disposed under an LCD panel. With an edge illumination type backlight assembly, a light source is disposed at a side of a light guide plate such that the light generated from the light source enters the light guide plate through the side and exits through an upper face of the light guide plate to propagate toward an LCD panel.

Recently, to prevent the decreasing of the contrast ratio (CR) of an image and to reduce power consumption, a local dimming driving method has been developed. In the local dimming driving method, a light source is divided into a plurality of light-emitting blocks, and the light-emitting blocks are controlled in accordance with luminance of an image corresponding to the light-emitting blocks.

The local dimming driving method may have advantages, such as enhancing CR and decreasing power consumption. However, the local dimming driving method may have disadvantages in that total brightness is decreased, a dark object displayed on a screen may not be visible, etc. Accordingly, a pixel correction, in which the brightness of pixel data is increased by decreasing a backlight, may prevent total luminance from being decreased. However, colors may be saturated or distorted.

Moreover, since the local dimming driving method is used to control the brightness of blocks, power consumption is decreased. However, the local dimming driving method includes driving per block, so that display quality deterioration and flicker may be generated and a boundary between blocks may be visible.

SUMMARY

Example embodiments of the present invention provide a method of driving a display apparatus capable of enhancing display quality.

According to an aspect of the present invention, a method of driving a display apparatus is provided. In the method, a luminance representative value of a unit light-emitting block is determined from an external image signal of a plurality of image blocks corresponding to the unit light-emitting block including a plurality of light sources. A luminance compensation value of the unit light-emitting block is calculated by compensating the luminance representative value. Pixel data of the external image signal in a central area of the unit light-emitting block and a boundary area is corrected based on the luminance compensation value. A driving signal is provided to the unit light-emitting block based on the luminance compensation value.

In an example embodiment of the present invention, compensating or correcting the pixel data of the external image signal of the boundary area of the unit light-emitting block may include applying a distance weight value based on a luminance compensation value of adjacent unit light-emitting blocks to correct the pixel data of the external image signal.

In an example embodiment of the present invention, determining the luminance representative value of the unit light-emitting block may include obtaining the maximum gradation value and an average gradation value from the external image signal of the image blocks, and determining a predetermined value between the maximum gradation value and the average gradation value as a luminance representative value of the unit light-emitting block.

In an example embodiment of the present invention, compensating or calculating the luminance compensation value may include low-pass filtering a luminance representative value of the unit light-emitting block.

In an example embodiment of the present invention, low-pass filtering the luminance representative value of the unit light-emitting block may include calculating a luminance compensation value of the unit light-emitting block which is no less than a predetermined compensation ratio with respect to a maximum luminance representative value of luminance representative values of unit light-emitting blocks adjacent to the unit light-emitting block.

In an example embodiment of the present invention, the predetermined compensation ratio corresponding to a first area, in which a luminance representative value of the unit light-emitting block is relatively high, may be different from the predetermined compensation ratio corresponding to a second area, in which a luminance representative value of the unit light-emitting block is relatively low.

In an example embodiment of the present invention, calculating the luminance compensation value further may include low-pass filtering a luminance representative value of the unit light-emitting block by each frame of the image signal.

In an example embodiment of the present invention, calculating the luminance compensation value may include low-pass filtering a luminance representative value of the unit light-emitting block by each frame of the image signal.

In an example embodiment of the present invention, low-pass filtering the luminance representative value may include calculating a luminance compensation value of an n-th unit light-emitting block by using the following equation:

$$Lk'(n)+R*Lk(n)+(1-R)*L'k-1(n)R=\min(1,PARA+|AVEk-AVEk-1|),$$ wherein,

Lk' denotes a luminance representative value of an k-th frame after compensating, Lk denotes a luminance representative value of the k-th frame, L'k−1 denotes a luminance representative value of a (k−1)-th frame after compensating, PARA denotes a low-pass filtering level, AVEk denotes an average gradation value of an external image signal of the k-th frame, and AVEk−1 denotes an average gradation value of the external image signal of the (k−1)-th frame.

In an example embodiment of the present invention, compensating or correcting the pixel data of the external image signal may include calculating an estimated values of luminance compensation value at the boundary area by employing a linear interpolation to the luminance compensation value of adjacent unit light-emitting blocks, and correcting pixel data of pixels corresponding to a boundary area of the unit light-emitting block based on the estimated values of the luminance compensation value.

In an example embodiment of the present invention, correcting the pixel data of the external image signal at the boundary area of the unit light-emitting block may include correcting pixel data of the external image signal by using the following equation:

$$G' = \alpha * G,\ \alpha = \frac{G_{max}}{G_{rep}},$$

wherein, G' denotes pixel data of an image signal IS after the pixel data of the image signal is compensated, G denotes pixel data of the image signal IS, Gmax denotes a maximum gradation value of the pixel data, Grep denotes a compensated luminance compensation value at a center area C of the unit light-emitting block B or an estimated value of a luminance compensation value at a boundary area A of the unit light-emitting block B, and DR denotes a dimming ratio.

In an example embodiment of the present invention, correcting the pixel data of the external image signal at the center area of the unit light-emitting block may include correcting pixel data of the external image signal by using the following equation:

$$G' = \alpha * G,\ \alpha = \frac{G_{max}}{G_{rep}},$$

wherein, G' denotes pixel data of an image signal IS after the pixel data of the image signal is compensated, G denotes pixel data of the image signal IS, Gmax denotes a maximum gradation value of the pixel data, Grep denotes a compensated luminance compensation value at a center area C of the unit light-emitting block B or an estimated value of a luminance compensation value at a boundary area A of the unit light-emitting block B, and DR denotes a dimming ratio.

In an example embodiment of the present invention, correcting the pixel data of the external image signal may further include calculating a corrected luminance compensation value in consideration with luminance interference of adjacent unit light-emitting blocks based on a luminance compensation value of the unit light-emitting block.

In an example embodiment of the present invention, providing a driving signal to the unit light-emitting block based on the luminance compensation value may include determining a duty cycle of the unit light-emitting block based on the luminance compensation value, and generating a driving signal in accordance with the duty cycle to provide the unit light-emitting block with the driving signal.

According to some example embodiments of the present invention, pixel data is compensated by applying a distance weight value at a boundary area of a unit light-emitting block based on a luminance compensation value in which a luminance representative value of a unit light-emitting block is temporary and spatially compensated, so that a phenomenon in which a boundary of the unit light-emitting block is visible is removed. Thus, the display quality of an image may be enhanced.

BRIEF DESCRIPTION OF THE DRAWINGS

The above and other features and advantages of embodiments of the present invention will become more apparent by describing in detailed example embodiments thereof with reference to the accompanying drawings, in which.

DETAILED DESCRIPTION

Figure 1:
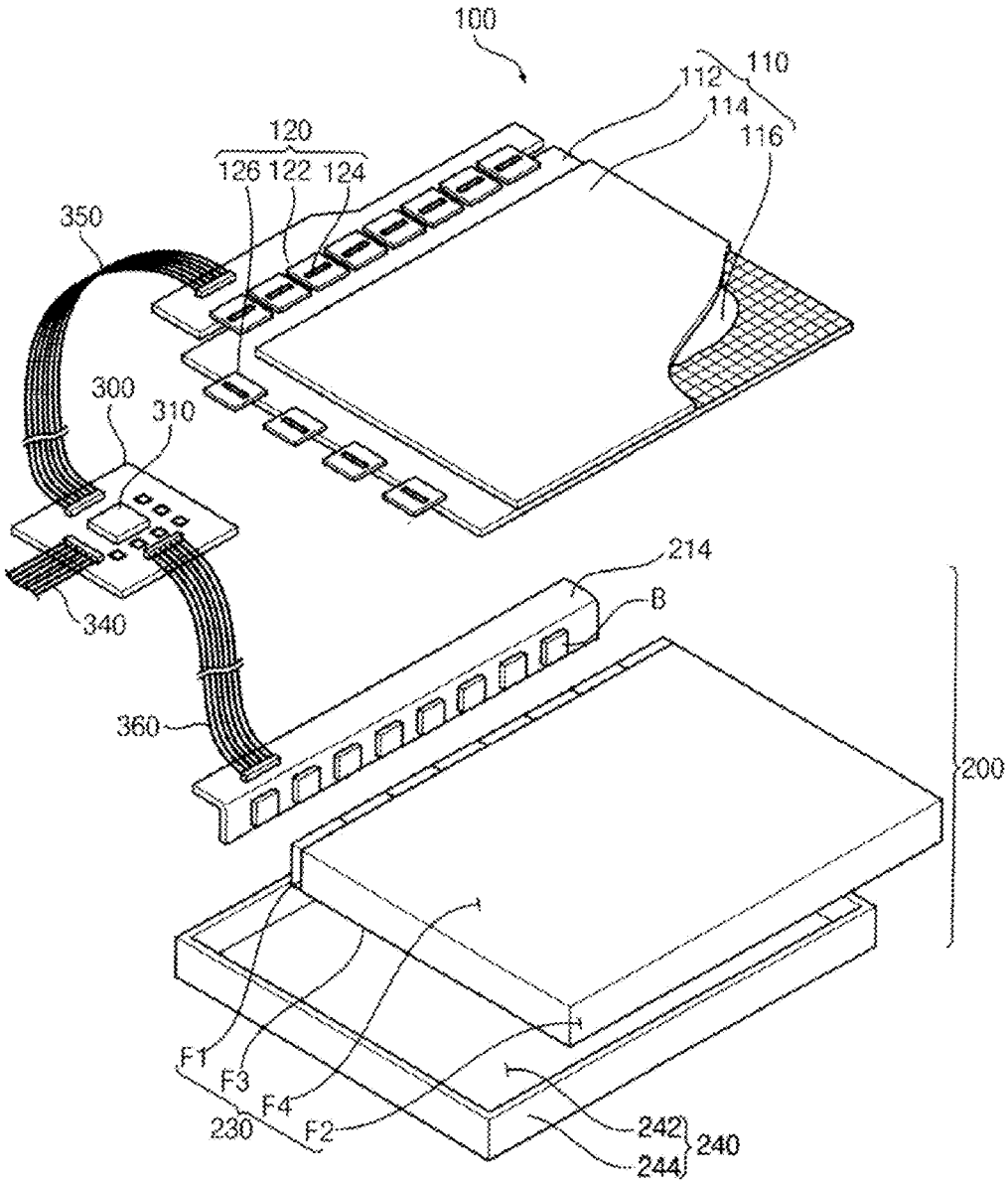
FIG. 1 is a perspective view illustrating a display apparatus, in accordance with an exemplary embodiment of the present invention.

Embodiments of the present invention are described more fully hereinafter with reference to the accompanying drawings, in which example embodiments of the present invention are shown. Example embodiments of the present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the present invention are described herein with reference to cross-sectional illustrations that are schematic illustrations of example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be explained in detail with reference to the accompanying drawings.

Figure 2:
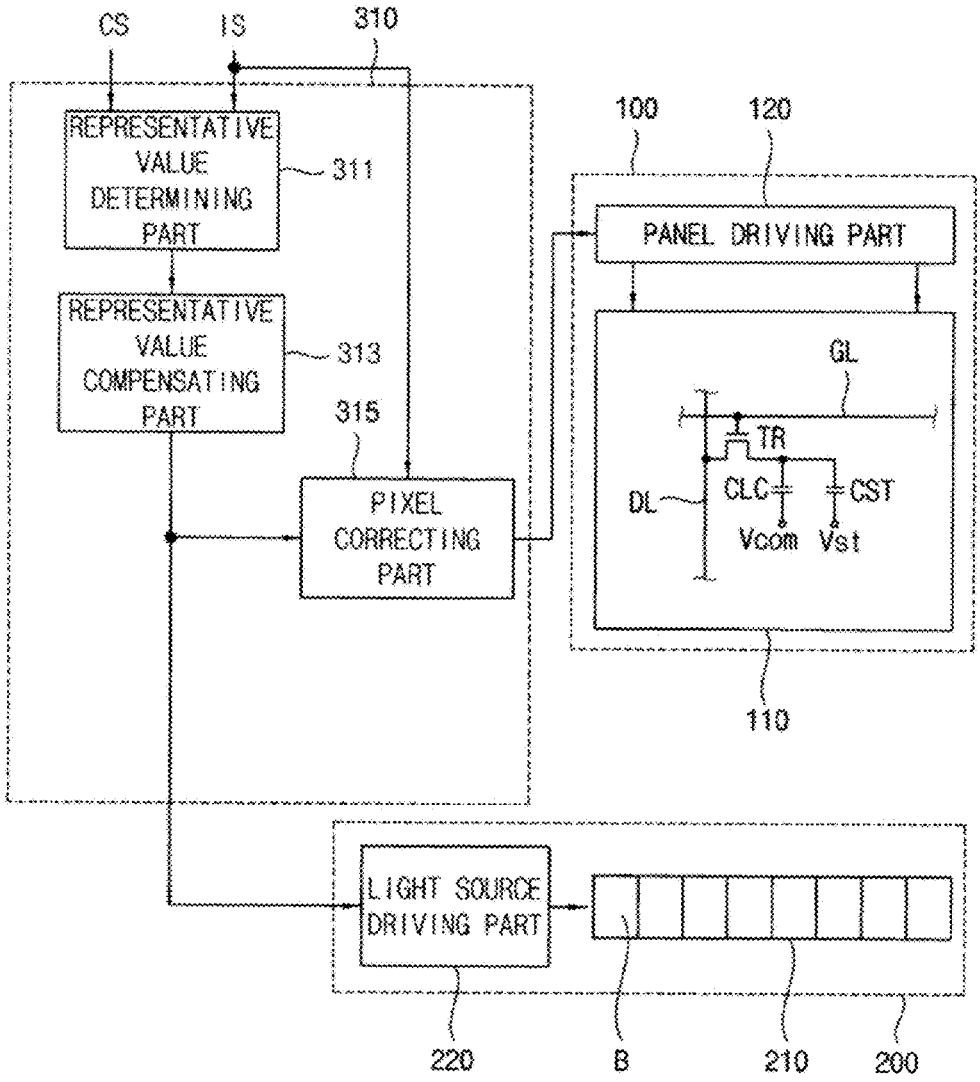
FIG. 2 is a block diagram schematically illustrating the display apparatus of FIG. 1, in accordance with an embodiment of the present invention.

FIG. 1 is a perspective view illustrating a display apparatus, in accordance with an exemplary embodiment of the present invention. FIG. 2 is a block diagram schematically illustrating the display apparatus of FIG. 1, in accordance with an embodiment of the present invention. Referring to FIGS. 1 and 2, a display apparatus according to one embodiment includes a display unit 100, a backlight unit 200, and a controller board 300.

The display unit 100 includes a display panel 110 and a panel driving part 120. The display panel 110 may include a first substrate 112, a second substrate 114 positioned opposite the first substrate 112, and a liquid crystal (LC) layer 116 interposed between the first substrate 112 and the second substrate 114. The first substrate 112 may include a plurality of pixels P displaying images. Each of the pixels P may include a switching element TR connected to a gate line GL and a data line DL, and a liquid crystal capacitor CLC and a storage capacitor CST that are connected to the switching element TR.

The panel driving part 120 may include a source printed circuit board (PCB) 122, a data PCB 124 connecting the source PCB 122 and the display panel 110, and a gate driving circuit film 126 connected to the display panel 110. The data driving circuit film 124 is connected to data lines of the first substrate 126 and is connected to gate lines of the first substrate 112. The data driving circuit film 124 and the gate driving circuit film 126 may include a driving chip which outputs a driving signal for driving the display panel 110 in response to a control signal provided from the source PCB 122.

The backlight unit 200 may include a light source 210, a light source driving part 220, a light guide plate 230, and a receiving container 240. The backlight unit 200 is disposed below the display unit 100 to provide the display unit 100 with light. The backlight unit 200 may be an edge type backlight unit disposed at a side of the light guide plate 230.

The light source 210 may be a point light source, for example, a light-emitting diode (LED). The light source 210 is mounted on a driving substrate 214. The driving substrate 214 may include a plurality of control lines (not shown) for delivering a control signal and a plurality of power lines (not shown) for providing power to the light source 210. The light source 210 may include white LEDs emitting a white light. Alternatively, the light source 210 may include red LEDs emitting red light, green LEDs emitting green light, and/or blue LEDs emitting blue light.

The light source 210 may include a plurality of unit light-emitting blocks B, and each unit light-emitting block B may include at least one LED. The unit light-emitting block B may be driven in a one-dimensional local dimming method in which the unit light-emitting block B is divided and driven with respect to one direction of a vertical direction or a horizontal direction. The unit light-emitting block B provides corresponding image blocks of the display panel 110 with light.

The light source driving part 220 determines a duty cycle of the unit light-emitting block B by using a luminance compensation value of the unit light-emitting block B output from the controller board 300 and generates a plurality of driving signals based on the duty cycle. The light source driving part 220 provides the unit light-emitting block B with the driving signals to drive each of the unit light-emitting block B. Hereinafter, the term "compensation" and/or "compensating" may be used the same meaning as "correction" and/or "correcting."

The light guide plate 230 is an optical plate which guides light exiting from the light source 210 to exit to an entire surface portion of the display panel 110. The light guide plate 230 may include a first surface F1, a second surface F2, a third surface F3, and a fourth surface F4. The first surface F1 is an incident portion of the light guide plate 230, and the third surface F3 is an exit portion of the light guide plate 230. The second surface F2 is a surface facing the first surface F1. The fourth surface F4 is parallel to the third surface F3, and is perpendicular to the first surface F1 and the second surface F2.

The receiving container 240 may receive the display unit 100, the light source 210, the light guide plate 230, etc. The receiving container 240 includes a bottom portion and a plurality of side walls 244 extended from edges of the bottom portion 242.

The backlight unit 200 may include optical sheets (not shown) disposed between the display panel 110 and the light guide plate 230 to enhance optical characteristics. For example, the optical sheets may include a diffusion sheet enhancing the luminance uniformity of light and at least one prism sheets increasing a front luminance of light.

The controller board 300 is electrically connected to the display unit 100 and the backlight unit 200 to control the display unit 100 and the backlight unit 200. The controller board 300 includes a controller unit 310, a first connector 340, a second connector 350, and a third connector 360.

The first connector 340 is connected to an external device (not shown). The first connector 340 provides the controller unit 310 with an image signal IS and a control signal CS provided from the external device. The second connector 350 is electrically connected to the display unit 100 to provide the display unit 100 with the image signal IS. The third connector 360 is electrically connected to the light source driving part 220 of the backlight unit 200.

The controller unit 310 includes a representative value determining part 311, a representative value compensating part 313, and a pixel correcting part 315. The representative value determining part 311 determines a luminance representative value of the unit light-emitting block B based on an external image signal provided to image blocks of the display panel 110 corresponding to the unit light-emitting block B. The representative value compensation part 313 compensates each of the luminance representative values to calculate a luminance compensation value. The luminance compensation value calculated from the representative value compensating part 313 is provided to the light source driving part 220 and the pixel correcting part 315. The pixel correcting part 315 applies a distance weight value to a boundary area of the unit light-emitting block B based on the luminance compensation value to correct pixel data of the image signal IS. The corrected pixel data is provided to the panel driving part 120.

Figure 3:
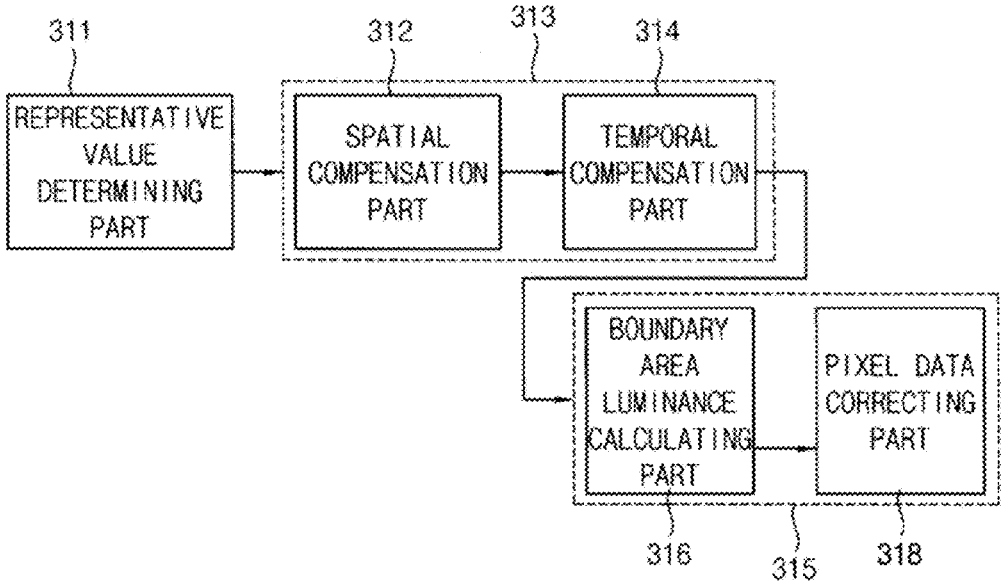
FIG. 3 is a block diagram illustrating a control unit of FIG. 2, in accordance with an embodiment of the present invention.
Figure 5:
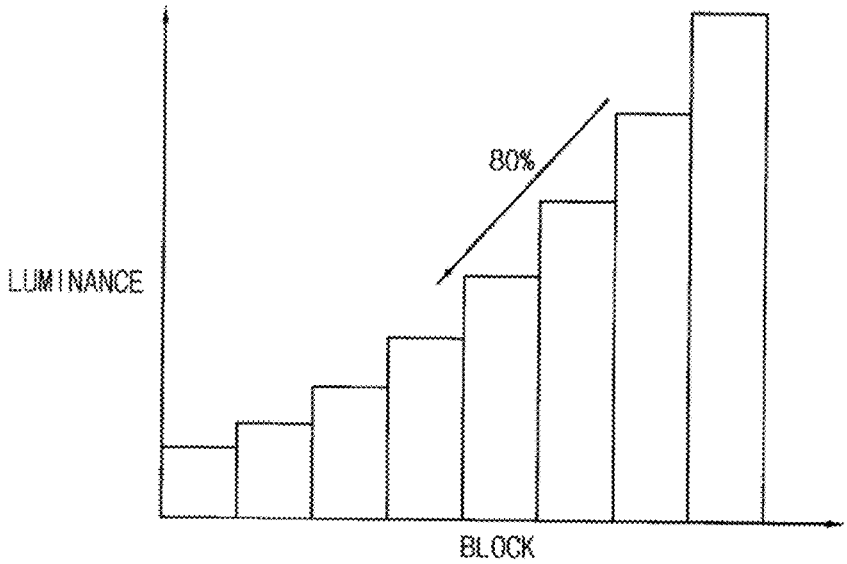
Figure 6:
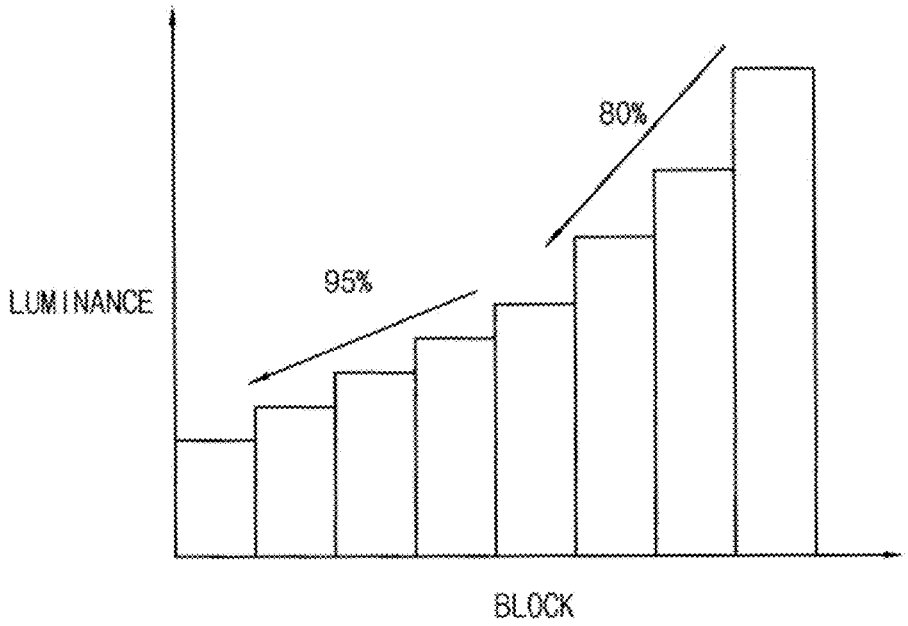
Figure 7A:
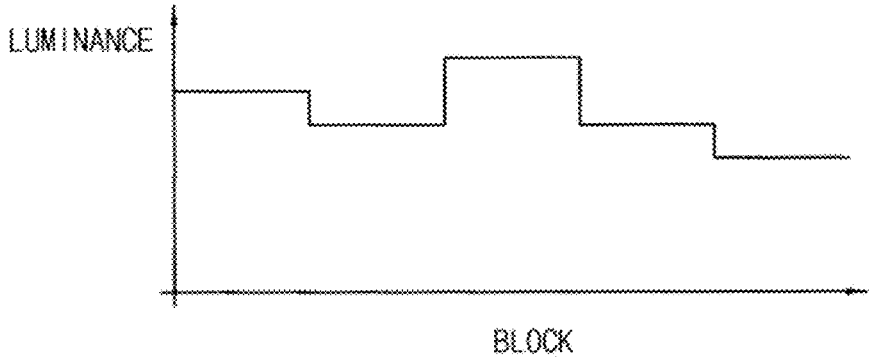
FIG. 7A is a conceptual diagram explaining a luminance compensation value of a unit light-emitting block which is calculated from a representative value compensating part, in accordance with an embodiment of the present invention.
Figure 7B:
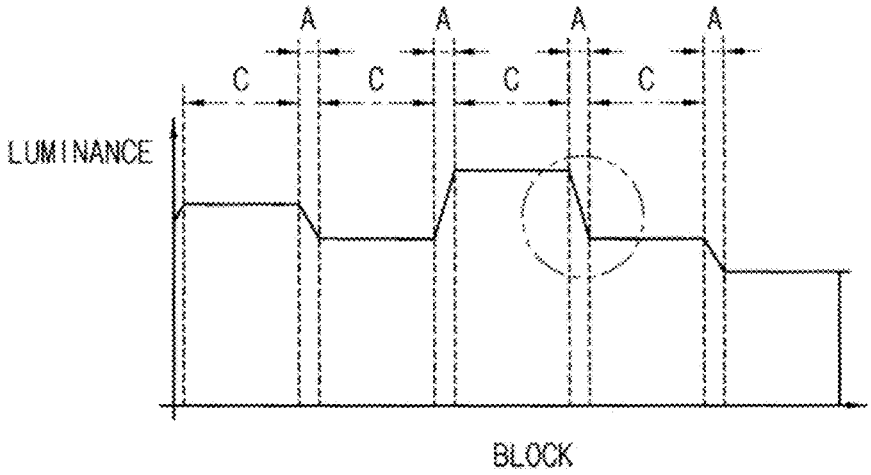
FIG. 7B is a conceptual diagram explaining an estimated value of a luminance compensation value when a distance weight value is applied to a luminance compensation value by using a linear interpolation method at a boundary area of a unit light-emitting block, in accordance with an embodiment of the present invention.
Figure 7C:
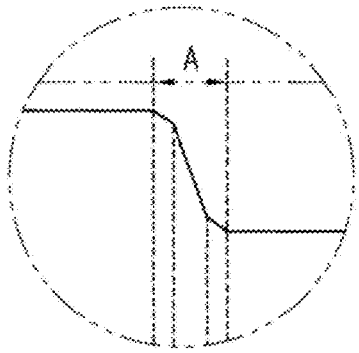
FIG. 7C is an enlarged plan view illustrating a boundary area 'A' of a unit light-emitting block 'B', in accordance with an embodiment of the present invention.
Figure 8A:
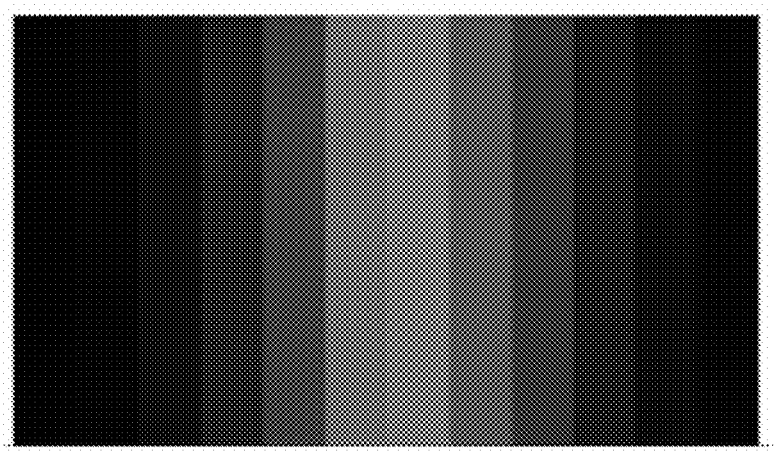
FIG. 8A is an optical profile which models a luminance compensation value of FIG. 7A, in accordance with an embodiment of the present invention.
Figure 8B:
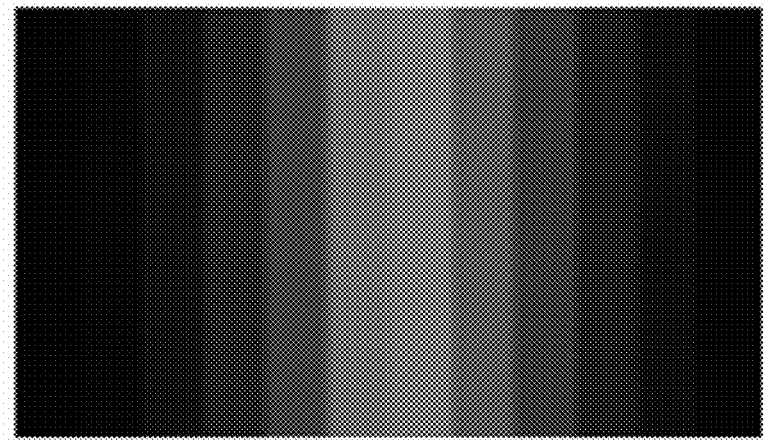
FIG. 8B is an optical profile which models an estimated value of the luminance compensation value of FIG. 7B, in accordance with an embodiment of the present invention.

The controller unit 310 will be explained in detail with reference to FIG. 3. FIG. 3 is a block diagram illustrating a control unit of FIG. 2, in accordance with an embodiment of the present invention. FIGS. 4, 5, and 6 are diagrams illustrating a luminance compensation value that is compensated by a spatial compensation part 312 of FIG. 3, in accordance with various embodiments of the present invention. FIG. 7A is a conceptual diagram explaining a luminance compensation value of a unit light-emitting block which is calculated from a representative value compensating part, in accordance with an embodiment of the present invention. FIG. 7B is a conceptual diagram explaining an estimated value of a luminance compensation value when a distance weight value is applied to a luminance compensation value by using a linear interpolation method at a boundary area of a unit light-emitting block, in accordance with an embodiment of the present invention. FIG. 7C is an enlarged plan view illustrating a boundary area 'A' of a unit light-emitting block 'B', in accordance with an embodiment of the present invention. FIG. 8A is an optical profile which models a luminance compensation value of FIG. 7A, in accordance with an embodiment of the present invention. FIG. 8B is an optical profile which models an estimated value of the luminance compensation value of FIG. 7B, in accordance with an embodiment of the present invention.

Referring to FIGS. 2 to 8, the controller unit 310 includes a representative value determining part 311, a representative value compensating part 313, and a pixel correcting part 315. The representative value determining part 311 obtains a luminance representative value of the unit light-emitting block B by using the control signal CS and the image signal IS provided from an external device (not shown) corresponding to a plurality of image blocks divided in correspondence with the unit light-emitting block B. The luminance representative value may be an intermediate gradation value between a maximum gradation value and an average gradation value of image signal IS included in each image blocks.

The representative value compensating part 313 may include a spatial compensation part 312 which low-pass filters a luminance representative value by the unit light-emitting block B. The spatial compensation part 312 may calculate a luminance compensation value of the unit light-emitting block B that is no less than a predetermined ratio with respect to the maximum luminance representative value of luminance representative values of the unit light-emitting block B adjacent to the unit light-emitting block B.

Figure 4A:
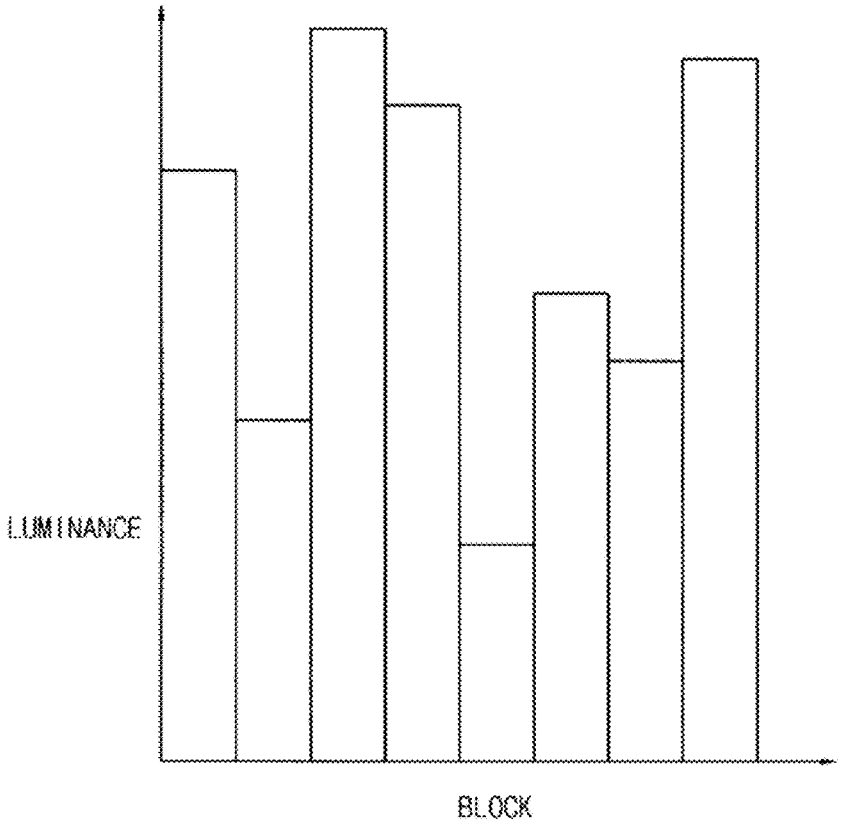
FIGS. 4, 5, and 6 are conceptual diagrams explaining a luminance compensation value that is compensated by a spatial compensation part of FIG. 3, in accordance with various embodiments of the present invention.
Figure 4B:
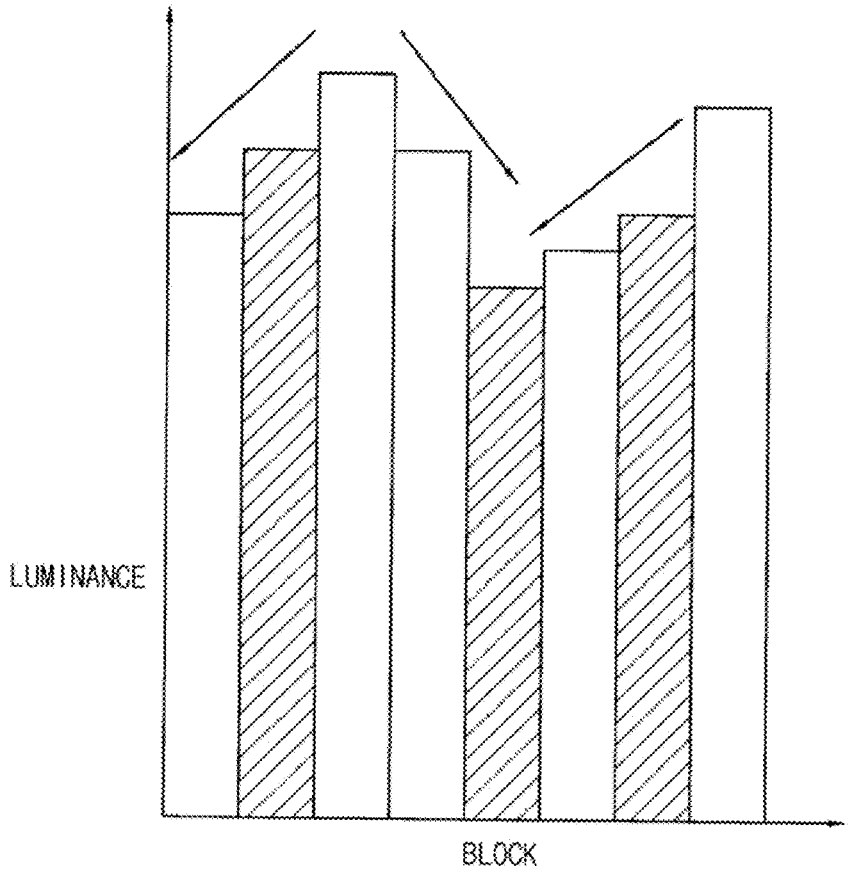

Referring to FIGS. 4A and 4B, FIG. 4A schematically shows a luminance representative value of the unit light-emitting block B determined at the representative value determining part 311, and FIG. 4B schematically shows a luminance compensation value of the unit light-emitting block B after the luminance representative value is low-pass filtered to be compensated.

When the determined luminance representative value is adapted to correct pixel data or drive the backlight unit 200, as shown in FIG. 4A, a dark block in which a luminance representative value is low between bright unit light-emitting blocks B may be generated. In this case, an image of the dark block may be darkly visible. Thus, as shown in FIG. 4B, the determined luminance representative value may be low-pass filtered, so that the brightness of the unit light-emitting block B may be controlled so as not to drop the determined luminance representative value to no more than a predetermined brightness in comparison with the brightness of the adjacent unit light-emitting block B.

FIGS. 5 and 6 are diagrams illustrating compensation examples in which a luminance representative value of a unit light-emitting block B is spatially low-pass filtered. As shown in FIG. 5, when a luminance representative value of each unit light-emitting block B has a value that is less than a first compensation ratio in comparison with a high value of a luminance representative value of adjacent unit light-emitting blocks B, each unit light-emitting block is compensated to have no less than the first compensation value of the maximum luminance representative value so that a luminance compensation value may be calculated. As a result, the luminance of a unit light-emitting block B may be decreased without rapid variation of a luminance representative value of adjacent unit light-emitting blocks B with respect to a unit light-emitting block B having the highest brightness that is positioned at a right side of FIG. 5. For example, the first compensation ratio may be about 80%.

As shown in FIG. 6, the luminance representative value of the unit light-emitting block B may be spatially low-pass filtered to have the different compensating amount in regard to an average brightness of the adjacent unit light-emitting block B. In this case, the brightness of the unit light-emitting blocks B having a relatively bright luminance is set to have a high compensation ratio so that power consumption may be decreased, and the brightness of the unit light-emitting blocks B having a relatively dark luminance is set to have a low compensation ratio so that disadvantages where a dark object is not visible may be solved.

Referring to FIG. 6, luminance representative values of bright unit light-emitting blocks B are gradually decreased by a first compensation ratio and a luminance representative value of dark unit light-emitting blocks B are gradually decreased by a second compensation ratio. For example, the first compensation ratio may be about 80%, and the second compensation ratio may be about 95%. In addition, the luminance representative values of the unit light-emitting blocks B that are classified by an average brightness may be compensated in compensation ratios different from each other. The compensation ratios may be more than two. The representative value compensating part 313 may include a temporal compensation part 314 which low-pass filters a luminance representative value of the unit light-emitting block B by each frame of the image signal IS.

When a moving image in which brightness is quickly varied is displayed, the brightness of the unit light-emitting block B between frames of the image signal IS so that flicker may be generated. In this case, a luminance representative value of the unit light-emitting block B is low-pass filtered at a time axis, so that brightness variation of blocks between frames may be controlled. The temporal compensation part 314 may compensate a luminance representative value of n-th unit light-emitting block B per each frame of an image signal IS by using the following Equation 1.

$$Lk'(n)=R*Lk(n)+(1-R)*L'k-1(n)$$

$$R=\min(1,PARA+|AVEk-AVEk-1|) \qquad \text{Equation 1}$$

In one aspect, Lk' denotes a luminance representative value of an k-th frame after compensating, Lk denotes a luminance representative value of the k-th frame, L'k−1 denotes a luminance representative value of a (k−1)-th frame after compensating, PARA denotes a low-pass filtering level, AVEk denotes an average gradation value of an external image signal of the k-th frame, and AVEk−1 denotes an average gradation value of the external image signal of the (k−1)-th frame. According to Equation 1, the brightness of a unit light-emitting block B may be compensated by using a brightness difference between a previous frame and a current frame.

The representative value compensating part 313 may include a spatial compensation part 312 and a temporal compensation part 314. The spatial compensation part 312 may low-pass filter a luminance representative value by the unit light-emitting block B at a space axis. The temporal compensation part 314 may low-pass filter a luminance representative value of the unit light-emitting block B at a time axis. Moreover, an employing sequence of the spatial compensation part 312 and the temporal compensation part 314 may be various. As shown in FIG. 3, when the spatial compensation part 312 is firstly employed rather than the temporal compensation part 314, Lk', Lk and L'k−1 of Equation 1 that is applied to the temporal compensation part 314 may represent a luminance compensation value that is calculated by the spatial compensation part 312 and not a luminance representative value of the unit light-emitting block B.

The representative value compensating part 313 calculates a luminance compensation value that each of the luminance representative value is compensated, and provides the light source driving part 220 and the pixel correcting part 315 with the luminance compensation value. The light source driving part 220 determines a duty cycle of the unit light-emitting block B with respect to the luminance compensation value. The light source driving part 220 generates a plurality of driving signals based on the duty cycle, and drives each of the unit light-emitting blocks B.

The pixel correcting part 315 compensates pixel data to enhance a luminance of an image so as to compensate that a whole screen is darker due to a dimming of a backlight. The pixel correcting part 315 applies a distance weight value to a boundary area of the unit light-emitting block B, based on the luminance compensation value provided from the representative value compensating part 313, to compensate pixel data of the image signal.

The pixel correcting part 315 may correct each pixel by setting a predetermined area between the unit light-emitting blocks B as a boundary area and setting the remaining area of the boundary area as a center area. Pixels corresponding to the center area may be corrected based on the luminance compensation value provided from the representative value compensation part 313. On the other hand, pixels corresponding to the boundary area may be corrected based on an estimated value by adding a distance weight value to a luminance compensation value, so that rapid luminance differences between unit light-emitting blocks B may be decreased.

FIG. 7A is a conceptual diagram explaining a luminance compensation value of a unit light-emitting block which is calculated from a representative value compensating part, in accordance with an embodiment of the present invention. FIG. 7B is a conceptual diagram explaining an estimated value of a luminance compensation value when a distance weight value is applied to a luminance compensation value by using a linear interpolation method at a boundary area of a unit light-emitting block B, in accordance with an embodiment of the present invention. FIG. 7C is an enlarged plan view illustrating a boundary area 'A' of a unit light-emitting block 'B', in accordance with an embodiment of the present invention.

As shown in FIG. 7A, rapidly stepped differences of luminance compensation values exist at the boundary area A of the unit light-emitting block B. However, as shown in FIGS. 7B and 7C, stepped differences of luminance compensation values are gradually decreased at the boundary area A of the unit light-emitting block B.

The pixel correcting part 315 includes a boundary area luminance calculating part 316 and pixel data correcting part 318. The pixel compensating part 315 may include a point spread function (PSF) part (not shown).

The PSF part corrects a luminance compensation value calculated at the representative value compensating part 313 in reference to luminance interference of a peripheral unit light-emitting blocks B which influences a luminance of the unit light-emitting block B. The pixel data may be applied to the pixel of the display panel through the boundary area luminance calculating part 316 and the pixel data correcting part 318 based on the luminance correction value that is compensated at the PSF part.

The boundary area luminance calculating part 316 may apply a luminance compensation value or a luminance compensation value corrected by the PSF part calculate by using a linear interpolation method. Thus, estimated values of a luminance compensation value or estimated values of the corrected luminance compensation value may be calculated in the boundary area A of the unit light-emitting block B.

As shown in FIG. 7B, the pixel data correcting part 318 may calculate pixel data cola center area C and a boundary area A of the unit light-emitting block B, based on an estimated value of the corrected unit light-emitting block B by the PSF part and estimated values of the luminance compensation value at a boundary area A that are calculated by a linear interpolation method by the boundary area luminance calculating part 316. The boundary area luminance calculating part 316 gradually decreases a difference of the luminance compensation value at a boundary area A of the unit light-emitting block B, so that disadvantages where a boundary area between unit light-emitting blocks B is visible, which is generated due to rapid luminance differences in the boundary area A of the unit light-emitting block B, may be solved.

FIG. 8A is an optical profile that models a luminance compensation value of FIG. 7A, in accordance with an embodiment of the present invention. FIG. 8B is an optical profile which models an estimated value of the luminance compensation value of FIG. 7B, in accordance with an embodiment of the present invention.

Referring to FIGS. 8A and 8B, when a distance weight value is applied to the luminance compensation value by using a linear interpolation method at the boundary area of unit light-emitting blocks B, it is recognized that the visibility of the boundary between the unit light-emitting blocks B may be decreased. The pixel data correcting part 318 corrects pixel data of the image signal IS based on the corrected luminance compensation value of the unit light-emitting block B and estimated values of the luminance compensation value at the boundary area A that are calculated by the boundary area luminance calculating part 316. The correction of the pixel data uses a slope value based on a gamma equation, and thus a calculation may be omitted. Therefore, hardware size may be decreased. The pixel data of the image signal IS may be corrected by multiplying a correction coefficient in accordance with a dimming of the backlight unit 200 based on gamma characteristics of the display panel 110. When the gamma value of the display panel 110 is 2.2, the correction coefficient 'α' may be defined by the following Equation 2.

$$G' = \alpha * G \qquad \text{Equation 2}$$

$$L_{max} \cdot (DR) \cdot \left(\frac{G'}{G_{max}}\right)^{2.2} = L_{max} \cdot \left(\frac{G}{G_{max}}\right)^{2.2}$$

$$DR = \left(\frac{G_{rep}}{G_{max}}\right)^{2.2}$$

-continued $$L_{max} \cdot \left(\frac{G_{rep}}{G_{max}}\right)^{2.2} \cdot \left(\frac{G'}{G_{max}}\right)^{2.2} = L_{max} \cdot \left(\frac{G}{G_{max}}\right)^{2.2}$$

$$G' = \frac{G_{max}}{G_{rep}} \cdot G$$

$$\therefore \alpha = \frac{G_{max}}{G_{rep}}$$

In one aspect, G' denotes pixel data of an image signal IS after the pixel data of the image signal is compensated, G denotes pixel data of the image signal IS, Gmax denotes a maximum gradation value of the pixel data, Grep denotes a compensated luminance compensation value at a center area C of the unit light-emitting block B or an estimated value of a luminance compensation value at a boundary area A of the unit light-emitting block B, and DR denotes a dimming ratio. Referring to Equation 1, pixel data of the image signal IS may be corrected by multiplying a compensating coefficient 'α'.

Figure 9:
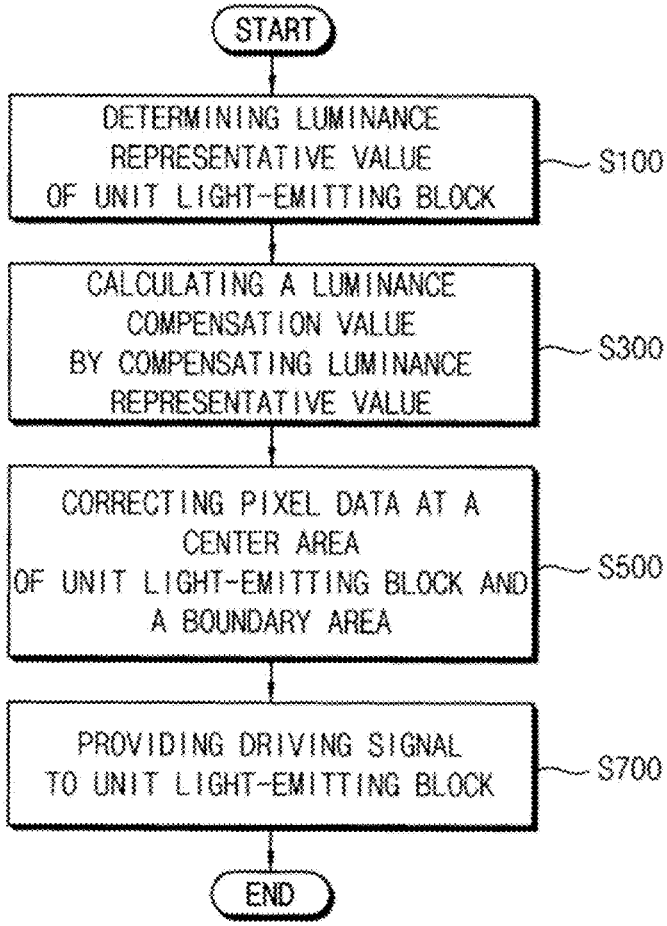
FIG. 9 is a flowchart showing a method of driving a display apparatus, in accordance with an exemplary embodiment of the present invention.

FIG. 9 is a flowchart showing a method of driving a display apparatus, in accordance with an exemplary embodiment of the present invention. Referring to FIGS. 1 to 9, the representative value determining part 311 determines a luminance representative value of the unit light-emitting block B from an external image signal IS corresponding to a plurality of image blocks corresponding to the unit light-emitting block B (step S100). The representative value compensating part 313 compensates each of the luminance representative values to calculate a luminance compensation value of the unit light-emitting block B (step S300).

The pixel correcting part 315 corrects pixel data of the image signal IS at a center area C and a boundary area A of the unit light-emitting block B based on the luminance compensation value (step S500). In step S500, a step of calculating the corrected luminance compensation value that is corrected by the PSF part may be further performed. The PSF part corrects a luminance compensation value in regard to luminance interference of adjacent unit light-emitting blocks B based on the luminance compensation value. In this case, the pixel correcting part 315 may correct pixel data of the image signal IS at the center area C and the boundary area A of the unit light-emitting block B, based on the corrected luminance compensation value.

The light source driving part 220 determines a duty cycle of the unit light-emitting block B based on the luminance compensation value, generates a plurality of driving signals based on the duty cycle, and provides the unit light-emitting block B with the driving signals to drive each of the unit light-emitting blocks B (step S700). The display unit 100 displays an image based on the corrected pixel data, and the backlight unit 200 generates a driving signal based on the luminance compensation value to provide the unit light-emitting block B with the driving signal.

For example, in step S100 in which the luminance representative value of the unit light-emitting block B is determined, the representative value determining part 311 obtains a maximum gradation value and an average gradation value of luminance of the unit light-emitting block 311 by using the control signal CS and the image signal IS that are provided from an external device (not shown). The control signal CS and the image signal IS may correspond to a plurality of image blocks that is divided into in correspondence with the unit light-emitting block B. The representative value determining part 311 may determine a predetermined value between the maximum gradation value and the average gradation value of the unit light-emitting block B as a luminance representative value of the unit light-emitting block B.

In step S300 in which the luminance compensation value is calculated, the spatial compensation part 312 may low-pass filter a luminance representative value per the unit light-emitting block B. The spatial compensation part 312 may calculate a luminance compensation value of the unit light-emitting block B that is no less than a predetermined ratio with respect to the maximum luminance representative value of luminance representative values of the unit light-emitting block B adjacent to the unit light-emitting block B.

As shown in FIG. 4B, the determined luminance representative value may be low-pass filtered, so that the brightness of the unit light-emitting block B may be controlled so as not to drop the determined luminance representative value to no more than a predetermined brightness in comparison with the brightness of the adjacent unit light-emitting block B.

As shown in FIG. 5, when a luminance representative value of each unit light-emitting block B has a value that is less than a first compensation ratio in comparison with a high value of a luminance representative value of adjacent unit light-emitting blocks B, each unit light-emitting block is corrected to have no less than the first compensation value of the maximum luminance representative value so that a luminance compensation value may be calculated. As a result, the luminance of the unit light-emitting block B may be decreased without rapid variation of a luminance representative value of adjacent unit light-emitting blocks B with respect to a unit light-emitting block B having the highest brightness that is positioned at a right side of FIG. 5. For example, the first compensation ratio may be about 80%.

Moreover, as shown in FIG. 6, the luminance representative value of the unit light-emitting block B may be spatially low-pass filtered to have the different compensating amount in regard to an average brightness of the adjacent unit light-emitting block B. In this case, the brightness of the unit light-emitting blocks B having a relatively bright luminance is set to have a high compensation ratio so that power consumption may be decreased, and the brightness of the unit light-emitting blocks B having a relatively dark luminance is set to have a low compensation ratio so that disadvantages where a dark object is not visible may be solved.

In FIG. 6, luminance representative values of bright unit light-emitting blocks B are gradually decreased by a first compensation ratio and a luminance representative value of dark unit light-emitting blocks B are gradually decreased by a second compensation ratio. For example, the first compensation ratio may be about 80%, and the second compensation ratio may be about 95%. In addition, the luminance representative values of the unit light-emitting blocks B that are classified by an average brightness may be compensated in compensation ratios different from each other. The compensation ratios may be more than two.

In step S300, the temporal compensation part 314 may low-pass filter the luminance representative value of the unit light-emitting block B by each frame of the image signal IS. The temporal compensation part 314 may low-pass filter a luminance representative value of the unit light-emitting block B at a time axis, so that brightness variation of blocks between frames may be controlled.

The temporal compensation part 314 may compensate the luminance representative value of the n-th unit light-emitting block B by each frame of the image signal IS by using Equation 1. According to Equation 1, the brightness of the unit light-emitting block B may be compensated by using a brightness difference between a previous frame and a current frame.

Therefore, when a moving image in which a brightness thereof is rapidly varied is displayed on a screen, flicker may be prevented, which is generated due to that the brightness of the unit light-emitting block B between frames of the image signal IS is instantly varied.

In step S500, in order to compensate that a full screen is dark due to a dimming driving of the backlight unit 200, the pixel correcting part 315 corrects pixel data to increase luminance of an image. The pixel correcting part 315 corrects pixel data of the image signal IS by applying a distance weight value to a boundary are of the unit light-emitting block B based on a luminance compensation value provided from the representative value compensating part 313.

The pixel correcting part 315 may correct each pixel by setting a predetermined area between the unit light-emitting blocks B as a boundary area and setting the remaining area of the boundary area as a center area. Pixels corresponding to the center area may be corrected based on the luminance compensation value. On the other hand, pixels corresponding to the boundary area may be corrected based on an estimated value by adding a distance weight value to a luminance compensation value, so that rapid luminance differences between unit light-emitting blocks B may be decreased.

As shown in FIG. 7A, rapidly stepped differences of luminance compensation values exist at the boundary area A of the unit light-emitting block B. However, as shown in FIGS. 7B and 7C, stepped differences of luminance compensation values are gradually decreased at the boundary area A of the unit light-emitting block B. The pixel correcting part 315 includes a boundary area luminance calculating part 316 and pixel data correcting part 318. The pixel compensating part 315 may further include a point spread function (PSF) part (not shown).

The PSF part corrects a luminance compensation value calculated at the representative value compensating part 313 in regard to luminance interference of a peripheral unit light-emitting blocks B which influences a luminance of the unit light-emitting block B. The pixel data may be applied to the pixel of the display panel through the boundary area luminance calculating part 316 and the pixel data correcting part 318 based on the luminance correction value that is corrected at the PSF part.

When the boundary area luminance calculating part 316 obtains pixel data of a pixel corresponding to the boundary area A of the unit light-emitting block B, the boundary area luminance calculating part 316 applies a distance weight value to the luminance compensation value or the corrected luminance compensation value that is corrected by the PSF part to calculate an estimated value of the luminance compensation value corresponding to the boundary area A.

For example, the boundary area luminance calculating part 316 may apply a luminance compensation value or a luminance compensation value corrected by the PSF part calculate by using a linear interpolation method. Thus, estimated values of a luminance compensation value or estimated values of the corrected luminance compensation value may be calculated in the boundary area A of the unit light-emitting block B.

As shown in FIG. 7B, the pixel data correcting part 318 may calculate pixel data of a center area C and a boundary area A of the unit light-emitting block B, based on an estimated value of the corrected unit light-emitting block B by the PSF part and estimated values of the luminance compensation value at a boundary area A that are calculated in a linear interpolation method by the boundary area luminance calculating part 316. The boundary area luminance calculating part 316 gradually decreases a difference of the luminance compensation value at a boundary area A of the unit light-emitting block B, so that disadvantages in that a boundary area between unit light-emitting blocks B is visible, which is generated due to rapid luminance differences in the boundary area A of the unit light-emitting block B, may be solved.

As shown in FIGS. 8A and 8B, when a distance weight value is applied to the luminance compensation value by using a linear interpolation method at the boundary area of unit light-emitting blocks B, it is recognized that the visibility of the boundary between the unit light-emitting blocks B may be decreased.

The pixel data correcting part 318 corrects pixel data of the image signal IS based on the corrected luminance compensation value of the unit light-emitting block B and estimated values of the luminance compensation value at the boundary area A that are calculated by the boundary area luminance calculating part 316. The correction of the pixel data uses a slope value based on a gamma equation, and thus a calculation may be omitted. Therefore, hardware size may be decreased. The pixel data of the image signal IS may be corrected by multiplying a correction coefficient in accordance with a dimming of the backlight unit 200 based on gamma characteristics of the display panel 110. The correction coefficient '$\alpha$' of the pixel data may be defined by Equation 2. In one aspect, referring to Equation 2, pixel data of the image signal IS may be corrected by multiplying a correction coefficient.

As described above, according to the present invention, a luminance representative value of the unit light-emitting block B is compensated in temporal and spatial and then the pixel data is corrected, so that flicker generated between unit light-emitting blocks B and between frames of an image signal may be removed. Moreover, difference of luminance compensation values at the boundary area A of the unit light-emitting block B may be decreased to correct pixel data of the image signal IS, so that the visibility of a boundary of the unit light-emitting block B may be decreased so that display quality may be enhanced.

As described above, the method of driving a display apparatus according to the present invention is applied to a display apparatus having a backlight unit such as an LED. Hereinafter, another example of a display apparatus applying the method of driving a display apparatus according to the present invention will be described.

Figure 10:
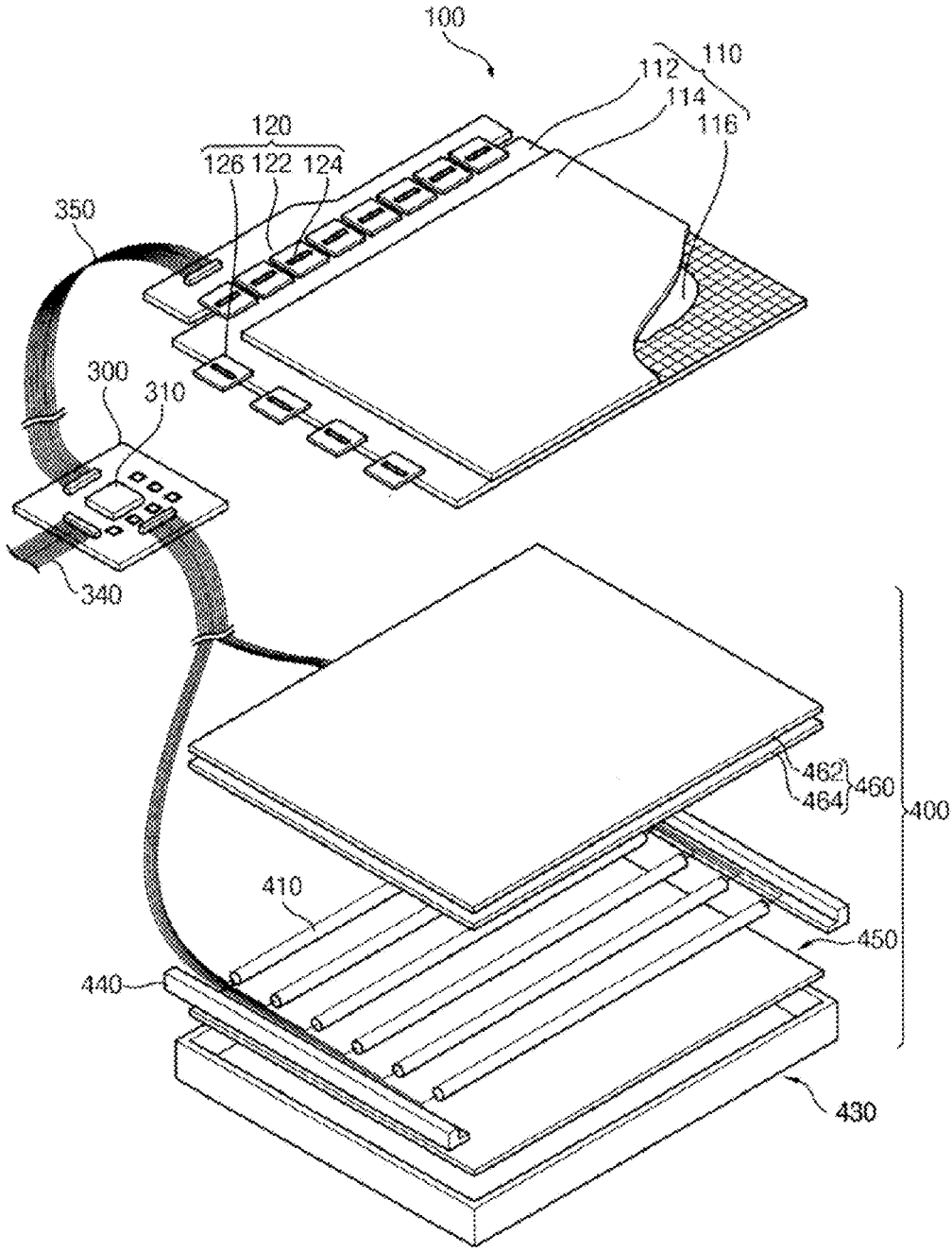
FIG. 10 is a perspective view illustrating a display apparatus, in accordance with another exemplary embodiment of the present invention.

FIG. 10 is a perspective view illustrating a display apparatus, in accordance with another exemplary embodiment of the present invention. Referring to FIG. 10, a display apparatus according to another exemplary embodiment of the present invention includes a display unit 100, a backlight unit 400 and a controller board 300. The display apparatus according to another exemplary embodiment of the present invention is substantially the same as the display apparatus of FIG. 1 except for at least the backlight unit 400. Thus, identical reference numerals are used in FIG. 10 to refer to components are the same or like those shown in FIG. 1, and thus, a detailed description thereof will be omitted.

The backlight unit 400 may include a plurality of lamps 410, a light source driving part 220 and a receiving container 430. The backlight unit 400 is disposed below the display unit 100 to provide the display unit 100 with light. The light source driving part 220 according to the present embodiment of the present invention is substantially the same as the light source driving part 220 of FIG. 2. Thus, the same reference numerals will be used to refer to the same or like parts as those described in this embodiment and any further explanation concerning the above elements will be omitted.

The lamps 410 are disposed on the receiving container 430 to be driven in a vertical direction crossing a length direction of the lamps 410. That is, the lamps 410 may employ a first dimension dimming method in which the lamps 410 are classified into a predetermined number with respect to the vertical direction to be driven.

In one example, the lamps may be sequentially driven in the vertical direction by a unit of one lamp. Here, one lamp may define a unit light-emitting block B.

In another example, the lamps may be sequentially driven in the vertical direction by a unit of two or more than two lamps. Here, the two or more than two lamps may define a unit light-emitting block B. A plurality of supporting members 440 respectively supporting two end portions of the lamps may be further disposed on the backlight unit 400. One supporting member 442 may support a first end portion of the lamp, and the another supporting member 444 may support a second end portion of the lamp.

In one aspect, the receiving container 430 may receive the display unit 100 and the lamps 410. The backlight unit 400 may further include a reflection sheet 450 disposed between the lamps 410 and the receiving container 430 to reflect light emitted from the lamps 410 to the display unit 100. The backlight unit 400 may further include optical sheets 460 disposed on the lamps 410 to enhance optical characteristics. For example, the optical sheets 460 may include a diffusion sheet 462 enhancing the luminance uniformity of light and at least one prism sheet 464 enhancing a front luminance of light.

As described above, according to an embodiment of the present invention, the backlight unit may be driven by using a local dimming driving method, so that power consumption thereof may be decreased. Moreover, the pixel data may be corrected by applying a weight value in accordance with a distance at a boundary area of the unit light-emitting block, so that the display quality of the display apparatus may be enhanced.

The foregoing is illustrative of embodiments of the present invention and is not to be construed as limiting thereof. Although example embodiments of the present invention have been described, those skilled in the art will readily appreciate that many modifications are possible in the example embodiments without materially departing from the novel teachings and advantages of the present invention.

Accordingly, all such modifications are intended to be included within the scope of the present invention as defined in the claims. In the claims, means-plus-function clauses are intended to cover the structures described herein as performing the recited function and not only structural equivalents but also equivalent structures.

Therefore, it is to be understood that the foregoing is illustrative of embodiments of the present invention and is not to be construed as limited to the example embodiments disclosed herein, and that modifications to the disclosed example embodiments, as well as other example embodiments, are intended to be included within the scope of the appended claims. The present invention is defined by the following claims, with equivalents of the claims to be included therein.

What is claimed is:

1. A method of driving a display apparatus including a plurality of unit light-emitting blocks, the method comprising:

determining a luminance representative value of a unit light-emitting block from pixel data of a plurality of image blocks corresponding to the unit light-emitting block including a plurality of light sources;

calculating a luminance compensation value for the unit light-emitting block, the luminance compensation value calculated from the luminance representative value;

correcting pixel data of pixels disposed in a central area of the unit light-emitting block and pixel data of pixels disposed in a boundary area of the unit light-emitting block, based on the luminance compensation value; and providing a driving signal to the unit light-emitting block based on the luminance compensation value;

wherein, when the luminance representative value forms a ratio with respect to a maximum luminance representative value of luminance representative values of adjacent unit light-emitting blocks, where the ratio for each respective unit light-emitting block is less than a predetermined compensation ratio, the luminance compensation value is calculated, where the luminance compensation value forms a ratio with respect to the maximum luminance representative value, the ratio of the luminance compensation value being equal to or greater than the predetermined compensation ratio.

2. The method of claim 1, wherein the correcting the pixel data of pixels disposed in the boundary area of the unit light-emitting block comprises:

applying a distance weight value based on a luminance compensation value of adjacent unit light-emitting blocks to correct the pixel data.

3. The method of claim 1, wherein the determining the luminance representative value of the unit light-emitting block comprises:

obtaining a maximum gradation value and an average gradation value from the pixel data of the image blocks; and determining a predetermined value between the maximum gradation value and the average gradation value as the luminance representative value of the unit light-emitting block.

4. The method of claim 1, wherein the predetermined compensation ratio corresponding to a first area, in which a luminance representative value of the unit light-emitting block is relatively high, is different from the predetermined compensation ratio corresponding to a second area, in which a luminance representative value of the unit light-emitting block is relatively low.

5. The method of claim 1, wherein the calculating the luminance compensation value further comprises:

low-pass filtering a luminance representative value of the unit light-emitting block by each frame.

6. The method of claim 1, wherein the calculating the luminance compensation value comprises:

low-pass filtering a luminance representative value of the unit light-emitting block by each frame.

7. The method of claim 6, wherein the low-pass filtering the luminance representative value comprises:

calculating a luminance compensation value of an n-th unit light-emitting block by using the following equation:

$$Lk'(n)=R*Lk(n)+(1-R)*L'k-1(n)$$

$$R=\min(1,PARA+|AVEk-AVEk-1|)$$

wherein, Lk' denotes a luminance representative value of an k-th frame after compensating, Lk denotes a luminance representative value of the k-th frame, L'k-1 denotes a luminance representative value of a (k-1)-th frame after compensating, PARA denotes a low-pass filtering level, AVEk denotes an average gradation value of pixel data of the k-th frame, and AVEk-1 denotes an average gradation value of pixel data of the (k-1)-th frame.

8. The method of claim 1, wherein the correcting the pixel data comprises:

calculating estimated values of the luminance compensation value at the boundary area by employing a linear interpolation to luminance compensation values of adjacent unit light-emitting blocks; and correcting pixel data of pixels corresponding to the boundary area of the unit light-emitting block based on the estimated values of the luminance compensation value.

9. The method of claim 8, wherein the correcting the pixel data of pixels disposed in the boundary area of the unit light-emitting block comprises:

correcting pixel data by using the following equation:

$$G' = \alpha * G$$

$$\alpha = \frac{G_{max}}{G_{rep}}$$

wherein, G' denotes pixel data of an image signal IS after the pixel data of the image signal is compensated, G denotes pixel data of the image signal IS, Gmax denotes a maximum gradation value of the pixel data, and Grep denotes a compensated luminance compensation value at a center area C of the unit light-emitting block B or an estimated value of a luminance compensation value at a boundary area A of the unit light-emitting block B.

10. The method of claim 1, wherein the correcting the pixel data of pixels disposed in the central area of the unit light-emitting block comprises:

correcting pixel data by using the following equation:

$$G' = \alpha * G$$

$$\alpha = \frac{G_{max}}{G_{rep}}$$

wherein, G' denotes pixel data of an image signal IS after the pixel data of the image signal is compensated, G denotes pixel data of the image signal IS, Gmax denotes a maximum gradation value of the pixel data, and Grep denotes a compensated luminance compensation value at a center area C of the unit light-emitting block B or an estimated value of a luminance compensation value at a boundary area A of the unit light-emitting block B.

11. The method of claim 1, wherein the correcting the pixel data-further comprises:

calculating a corrected luminance compensation value in consideration with luminance interference of adjacent unit light-emitting blocks based on the luminance compensation value of the unit light-emitting block.

12. The method of claim 1, wherein the providing a driving signal to the unit light-emitting block based on the luminance compensation value comprises:

determining a duty cycle of the unit light-emitting block based on the luminance compensation value; and generating a driving signal in accordance with the duty cycle to provide the unit light-emitting block with the driving signal.

* * * * *